US006938809B1

(12) United States Patent
Schnell

(10) Patent No.: US 6,938,809 B1
(45) Date of Patent: Sep. 6, 2005

(54) NAIL LOCKOUT ASSEMBLY

(75) Inventor: John W. Schnell, Jackson, TN (US)

(73) Assignee: Porter-Cable Corporation, Jackson, TN (US)

( * ) Notice: Subject to any disclaimer, the term of this patent is extended or adjusted under 35 U.S.C. 154(b) by 52 days.

(21) Appl. No.: 10/666,448

(22) Filed: Sep. 17, 2003

Related U.S. Application Data

(60) Provisional application No. 60/411,563, filed on Sep. 18, 2002, provisional application No. 60/471,641, filed on May 19, 2003.

(51) Int. Cl.[7] ..... B27F 7/13

(52) U.S. Cl. ..... 227/8; 227/120; 227/136; 227/148

(58) Field of Search ..... 227/8, 107, 109, 227/119, 120, 136, 148; 206/338, 343–347

(56) References Cited

U.S. PATENT DOCUMENTS

| | | | | | |
|---|---|---|---|---|---|
| 4,597,517 | A | * | 7/1986 | Wagdy | 227/8 |
| 4,949,780 | A | | 8/1990 | Chen | 165/7 |
| D323,835 | S | | 2/1992 | Leu | D15/133 |
| 5,241,888 | A | | 9/1993 | Chen | 83/471.3 |
| 5,322,189 | A | * | 6/1994 | Oda | 221/227 |
| D351,605 | S | | 10/1994 | Chen | D15/138 |
| D368,701 | S | | 4/1996 | Foy | D14/100 |
| 5,579,975 | A | * | 12/1996 | Moorman | 227/8 |
| D386,192 | S | | 11/1997 | Chen | D15/132 |
| 5,694,714 | A | | 12/1997 | Basso et al. | 43/26.2 |
| D389,494 | S | | 1/1998 | Chen | D15/133 |
| D391,585 | S | | 3/1998 | Chen | D15/133 |
| D393,648 | S | | 4/1998 | Chen | D15/132 |
| 5,778,747 | A | | 7/1998 | Chen | 83/471.3 |
| 5,778,752 | A | | 7/1998 | Chen | 83/783 |
| D397,343 | S | | 8/1998 | Chen | D15/133 |
| 5,803,338 | A | * | 9/1998 | Singer et al. | 227/8 |
| 5,836,501 | A | | 11/1998 | Lai | 227/8 |
| 5,881,941 | A | | 3/1999 | Lai | 227/130 |

(Continued)

*Primary Examiner*—Rinaldi I. Rada
*Assistant Examiner*—Thanh Truong
(74) *Attorney, Agent, or Firm*—Suiter West Swantz pc llo

(57) ABSTRACT

A nail lockout assembly provides a way for an operator of a nail gun to have determined whether the nails being employed are properly aligned to allow for efficient operation of the nail gun. The nail lockout assembly may be employed in a nail loading assembly, such as an adjustable angle magazine, which is coupled with a nail driving assembly. A slotted guide member disposed in a housing of the nail loading assembly provides a determination of the angle of the nail loading assembly relative to the nail driving assembly through operational engagement with a projection. A linkage bar is coupled with the slotted guide member and translates the angle of the nail loading assembly to a pusher which engages a nail loaded in the nail loading assembly. A cover serrated member is coupled with a cover of the nail loading assembly. A pawl assembly is coupled with the linkage bar and may engage with the cover serrated member. An adapter couples with the pusher and the pawl assembly enabling rotational movement in each. The nail improperly aligned with the pusher causes the pawl assembly to engage with the cover serrated member and prevents the cover from closing along with preventing the pusher from advancing the nail in the nail loading assembly.

8 Claims, 7 Drawing Sheets

U.S. PATENT DOCUMENTS

| | | | | |
|---|---|---|---|---|
| 5,924,621 | A | 7/1999 | Hung | 227/130 |
| 5,934,539 | A | 8/1999 | Lee | 227/109 |
| 6,024,268 | A | 2/2000 | Horng-Lin | 227/120 |
| 6,024,269 | A | 2/2000 | Ho et al. | 227/130 |
| 6,059,166 | A | 5/2000 | Ho et al. | 227/130 |
| 6,059,167 | A | 5/2000 | Ho et al. | 227/130 |
| 6,089,436 | A | 7/2000 | Ho et al. | 227/130 |
| 6,149,046 | A | 11/2000 | Ho et al. | 227/8 |
| 6,170,729 | B1 | 1/2001 | Lin | 227/8 |
| 6,170,730 | B1 | 1/2001 | Lin | 227/119 |
| 6,173,963 | B1 | 1/2001 | Ho et al. | 277/361 |
| D442,190 | S | 5/2001 | Chen | D15/133 |
| 6,264,085 | B1 | 7/2001 | Ho et al. | 227/8 |
| 6,290,115 | B1 | 9/2001 | Chen | 227/120 |
| 6,296,168 | B1 | 10/2001 | Hung | 227/130 |
| D453,345 | S | 2/2002 | Chen | D15/133 |
| 6,392,381 | B1 | 5/2002 | Chen | 320/111 |
| 6,397,954 | B1 | 6/2002 | Liu | 173/93.5 |
| 6,431,428 | B1 | 8/2002 | Chen | 227/120 |

* cited by examiner

NAIL LOCKOUT ASSEMBLY

CROSS REFERENCE TO RELATED APPLICATION

The present application claims priority under 35 U.S.C. §119(e) to the U.S. Provisional Application Ser. No. 60/411,563, filed on Sep. 18, 2002, and the U.S. Provisional Application Ser. No. 60/471,641, filed on May 19, 2003. The U.S. Provisional Application 60/411,563 and 60/471,641 are herein incorporated by reference in their entireties.

FIELD OF THE INVENTION

The present invention generally relates to the field of power tools, and particularly to a nail lockout assembly for use in a nail gun, such as a pneumatic nail gun.

BACKGROUND OF THE INVENTION

The use of power tools is commonplace in many workplace environments. A nail gun, such as pneumatic nail gun require the use of instruments (i.e., nails) that meet specific conditions in order to ensure proper operation of the nail gun. Use of incorrect nails may result in damage to the tool and lost time and money. Unfortunately, the tool itself often does not provide any effective way to verify that the nail being employed is correct and/or if the nail is not correct to prevent the nail from advancing within the tool.

Many of the pneumatic tool devices which employ instruments, such as nails in a collated nail strip, rely on the operator to determine the correct collated nail strip to employ. For instance, one nail gun may require the use of clipped head nails provided in a collated magazine at a specific angle. The operator of the nail gun is then required to provide these types of nails, the only verification is provided by the operator's skill, knowledge, and experience with the nail gun. However, it may be the case that one operator is less experienced than another or that the nail gun is provided to the operator already loaded with nails. There have been no effective ways provided by the current state of the art to enable the tool to verify that the correct nails are being employed, regardless of the skill, knowledge, and experience of the operator.

Therefore, it would be desirable to provide a pneumatic tool enabled to verify the correct use of instruments within it and prevent improper instruments from advancing and being operated upon which may result in serious harm to the tool.

SUMMARY OF THE INVENTION

Accordingly, the present invention is directed to a nail lockout assembly disposed within a pneumatic tool, such as a nail gun, which provides an operator of the pneumatic tool an effective way to ensure that only the correct instruments are loaded and advanced within the tool. The tool itself becomes a regulating device, in effect identifying for the operator whether the nails the operator has chosen are correct for the particular tool. By using the present invention, risk of harm to the tool may be significantly diminished, even if the operator is relatively inexperienced simply because the nails may not be allowed to advance in the tool if they are incorrect. In a first aspect of the present invention, a nail lockout assembly includes a slotted guide member for engaging a projection disposed in a nail loading assembly and for identifying to the nail lockout assembly the angle of coupling of a nail loading assembly to a nail driving assembly. The slotted guide member is coupled to a linkage bar which translates the movement of the slotted guide member. The linkage bar is coupled with a pusher which engages a nail and translates the alignment of the nail, by rotation of the pusher, to the linkage bar. A pawl assembly is coupled with the linkage bar, the pawl assembly is enabled to rotate into a first or a second position based on the position of the linkage bar. An adapter is coupled with the pusher and the pawl assembly, the adapter for enabling the rotational movement of the pusher and the pawl assembly. A cover serrated member disposed on a cover of the nail loading assembly may engage with the pawl assembly when the pawl assembly is in the second position. The pawl assembly allows the pusher and the nail to advance when the nail is properly aligned with the pusher. The pawl assembly prevents the cover from closing and the pusher and the nail from advancing by engaging with the cover serrated member when the nail is not properly aligned with the articulating pusher.

In a second aspect of the present invention, an adjustable angle magazine is provided which adjustably couples to a nail driving assembly of a nail gun. The adjustable angle magazine comprises a housing including a first end and a second end, the housing is coupled with a cover and the housing stores a nail and provides the nail to the nail driving assembly. An adjustment assembly is disposed proximal to the second end of the housing, the adjustment assembly for affixing the position of the housing relative to the nail gun. A universal adapter assembly is coupled to a first end of the adjustable angle magazine and enables the pivoting coupling of the adjustable angle magazine with the nail driving assembly. A nail lockout assembly is disposed upon the housing and cover, engaging with the nails loaded into the housing. The nail lockout assembly determines whether the nails are properly positioned and prevents the nails from advancing if the nails are improperly positioned.

In a third aspect of the present invention, an adjustable angle nail gun is provided. The adjustable angle nail gun comprises a handle with a first end and a second end coupled with a fastening assembly. A nail driving assembly including a driver blade is coupled with the first end of the handle and is for driving a nail. An adjustable angle nose casting assembly is coupled with the nail driving assembly. The adjustable angle nose casting assembly enables the operational engagement of the driver blade with the nail. An adjustable angle magazine for storing and providing the nail is pivotally coupled with the adjustable angle nose casting assembly. A universal adapter assembly is coupled with a first end of the adjustable angle magazine and enables the pivotal coupling of the adjustable angle magazine with the adjustable angle nose casting assembly. An adjustment assembly disposed proximal to the second end of the adjustable angle magazine couples with the fastening assembly. A nail lockout assembly is disposed upon the housing and cover, engaging with the nails loaded into the housing. The nail lockout assembly determines whether the nails are properly positioned and prevents the nails from advancing if the nails are improperly positioned.

In a fourth aspect of the present invention, a method for determining whether a proper collated nail strip has been loaded into a nail loading assembly for driving by a nail driving assembly of a nail gun. An operator of a nail gun selects and loads the collated nail strip into the nail loading assembly. As the nail strip advances through the nail loading assembly the nails are engaged by a nail lockout assembly. The nail lockout assembly determines whether the collated nail strip provides nails in the correct position for use by the nail gun. If the nails are correctly positioned then they are allowed to advance and be received into the nail driving assembly. If the nails are incorrectly positioned then they are not allowed to advance and are locked in place within the nail loading assembly.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference may now be made in detail to the presently preferred embodiments of the invention, examples of which are illustrated in the accompanying drawings.

Figure 1:
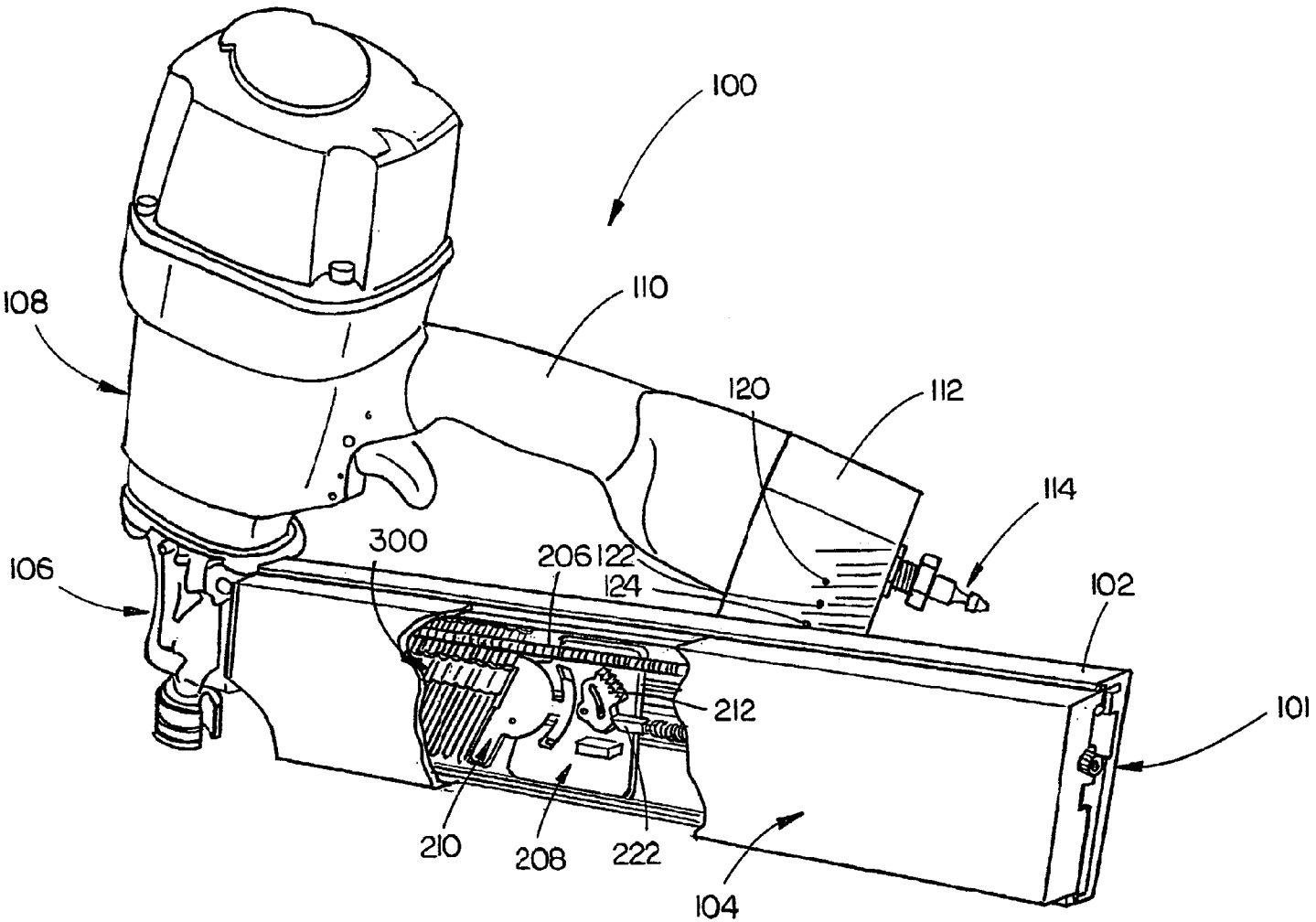
FIG. 1 is an illustration of an adjustable angle nail gun assembly in accordance with an exemplary embodiment of the present invention.

Referring generally now to FIGS. 1 through 6, exemplary embodiments of the present invention are shown. In FIG. 1 an adjustable angle nail gun assembly including an adjustable angle magazine 101 is shown. It is understood that while the preferred embodiments exemplify an adjustable angle magazine 101, other nail gun magazine or nail loading assembly configurations may be employed without departing from the scope and spirit of the present invention. The adjustable angle magazine 101 includes a housing 102 and a cover 104 and is shown enabled to couple with an adjustable angle nose casting assembly 106. The adjustable angle nail gun further comprises a casing 108 disposed with a nail driving assembly, the casing 108 is coupled with the adjustable angle nose casting assembly 106. A handle 110 couples with the casing 108 at one end and with a fastening assembly 112 at the opposite end. The fastening assembly 112 couples with the handle 110, a compressor connection assembly 114, and with the housing 102 of the adjustable angle magazine 101. The cover 104 is removable from the housing 102, preferably, sliding off to the end opposite the connection with the nose casting assembly 106. A nail lock out assembly 200 is disposed within the adjustable angle magazine 101.

Figure 2:
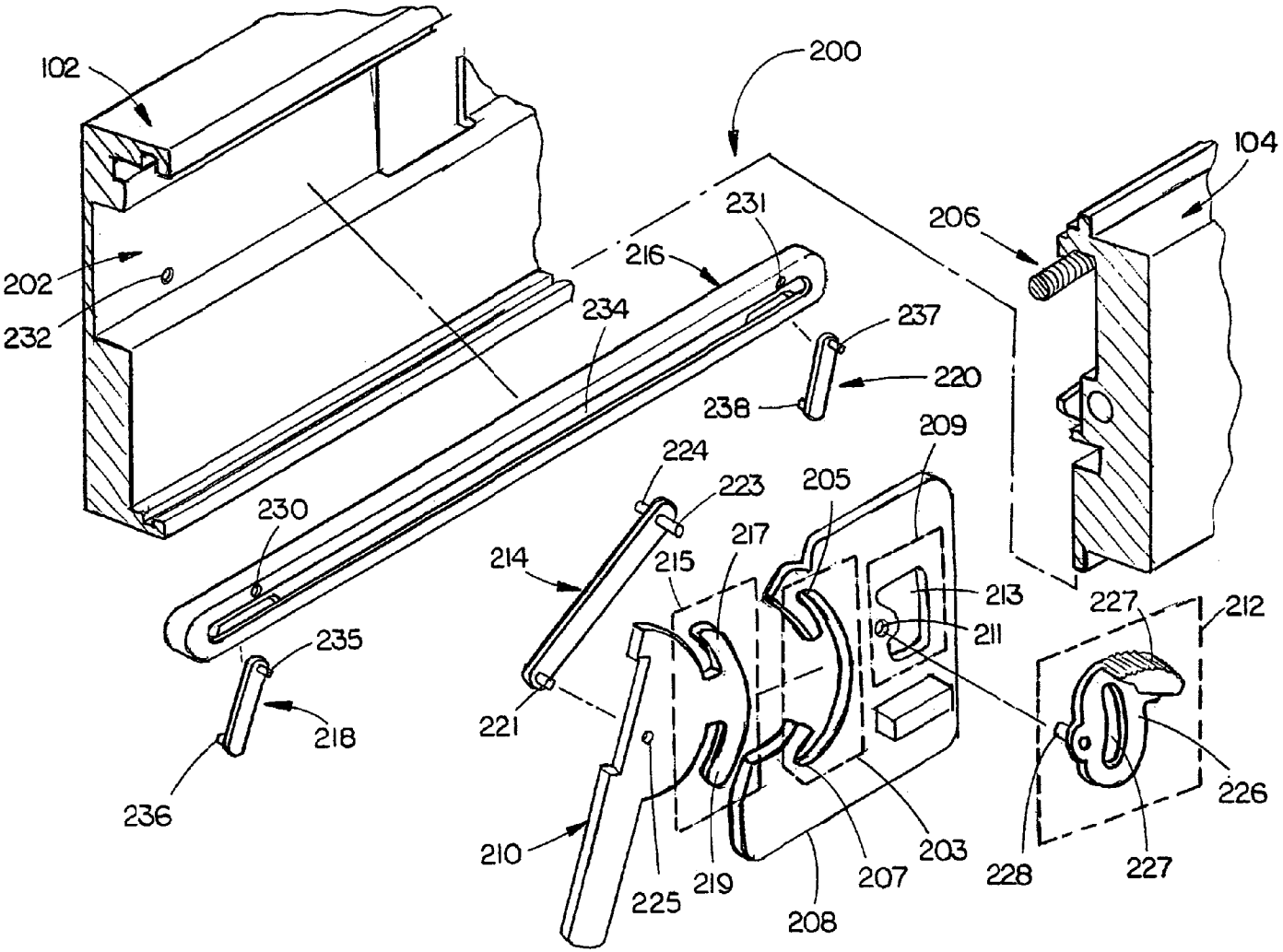
FIG. 2 is an exploded illustration of a nail lock out assembly in accordance with an exemplary embodiment of the present invention.

In FIG. 2 an exploded view of the nail lock out assembly 200 is shown. The nail lock out assembly 200 is for use within the adjustable angle magazine 101, comprising the housing 102 and the cover 104. The nail lock out assembly 200 comprises a cover serrated member 206 coupled with the cover 104. The cover serrated member 206 may be of variable dimensions to accommodate the needs of consumers and manufacturers. Disposed within the housing 102 and the cover 104 is a slotted four bar linkage assembly comprising, an adapter 208 which couples with a pusher 210 and a pawl assembly 212, a linkage bar 214, and a slotted guide member 216 coupled with a first guide linkage member 218 and a second guide linkage member 220. The pusher 210 is coupled to the pawl assembly 212 through the linkage bar 214. The linkage bar 214 also couples with the slotted guide member 216, which is operationally coupled with a base 202, disposed within the housing 102, by the first guide linkage member 218 and the second guide linkage member 220.

In the preferred embodiment, the adapter 208 includes a slotted pusher coupling assembly 203 comprising a top edge 205 and a bottom edge 207. The slotted pusher coupling assembly 203 operationally engages with an arm assembly 213 coupled with the pusher 210. The arm assembly 213, comprises an upper arm 217 and a lower arm 219. The arm assembly 213 slidably engages within the pusher coupling assembly 203, with the position of the arm assembly 213 being generally established by the angular setting of the adjustable angle magazine 101 relative to the adjustable angle nose casting assembly 106. The linkage bar 214 is disposed with a first post 221, a second post 223 and a third post 224. The first post 221 rotationally couples with the pusher receiver assembly 225. Further, disposed upon the adapter 208 is the pawl coupling assembly 209, comprising a pawl stud access point 211 and a pawl adapter 213. The pawl assembly 212 includes a body 226 coupled with a pawl serrated member 227, a pawl stud 228 and a pawl receiver assembly 229. The pawl stud 228 rotationally couples with the pawl stud access point 211. This coupling establishes the pivot axis of the pawl assembly 212 during operational use of the nail checker assembly 200. The pawl receiver assembly 229 is engaged, through the pawl adapter 213, by the second post 223 of the linkage bar 214. Movement of the linkage bar 214, translated through the second post 223, moves the pawl assembly into a first and a second position.

The third post 224, of the linkage bar 214, operationally couples with a slot 234 disposed within the slotted guide member 216. The slot 234 substantially extends the length of the slotted guide member 216. The first guide linkage member 218 includes a first linkage post 235 and a second linkage post 236. The first linkage post 235 rotationally couples with a first linkage adapter 230 disposed upon the slotted guide member 216. The second linkage post 236 rotationally couples with a first base linkage adapter 232 disposed within the base 202 of the housing 102. The second guide linkage member 2200 includes a third linkage post 237 and a fourth linkage post 238. The third linkage post 237 rotationally couples with a second linkage adapter 231 disposed upon the slotted guide member 216. The fourth linkage post 238 rotationally couples with a second base linkage adapter (not shown) disposed with the base 202.

Figure 3:
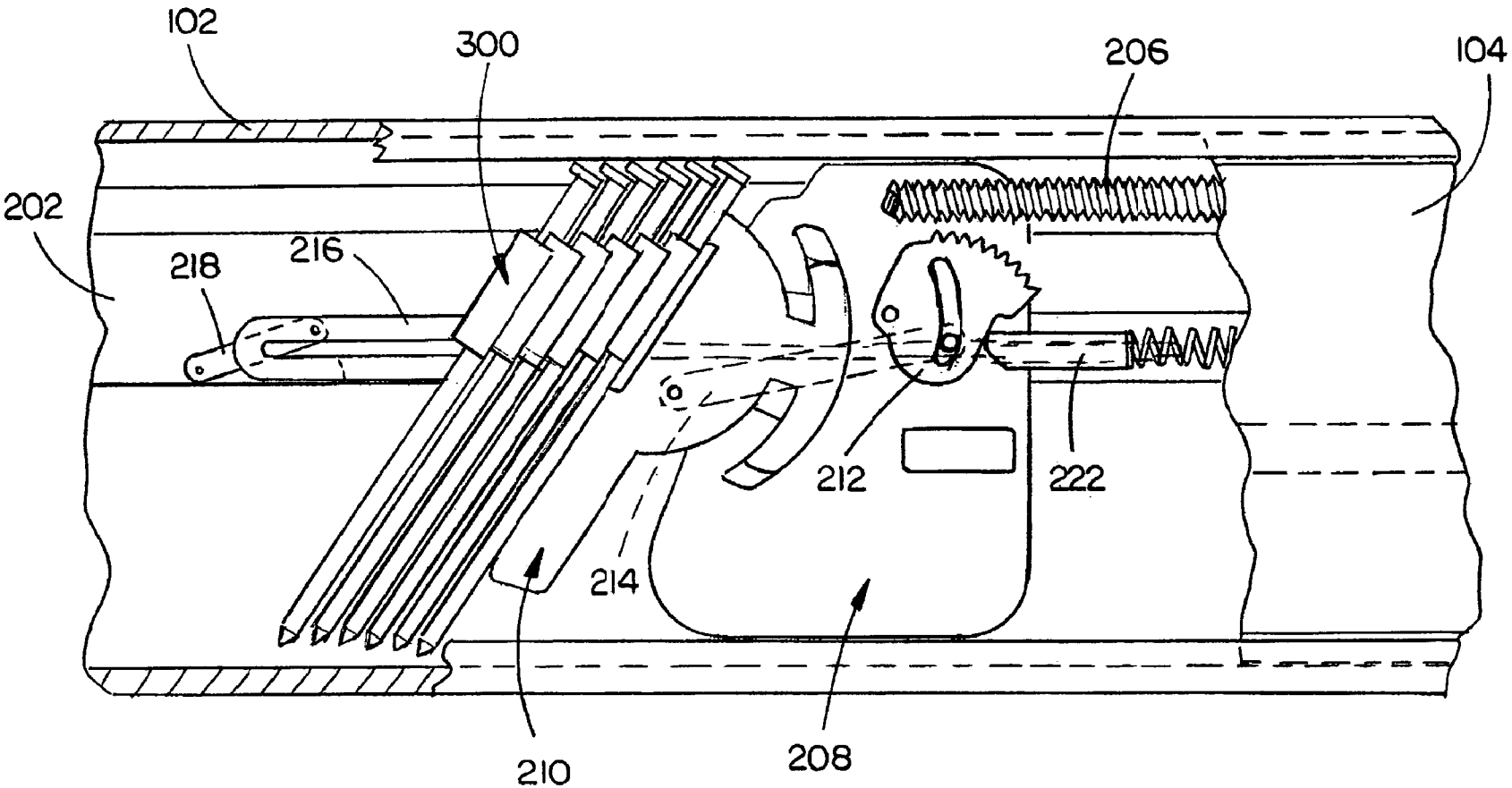
FIG. 3 is a cut-away view of the nail lock out assembly in a position where the clipped-head nail strip is being allowed to advance.
Figure 4:
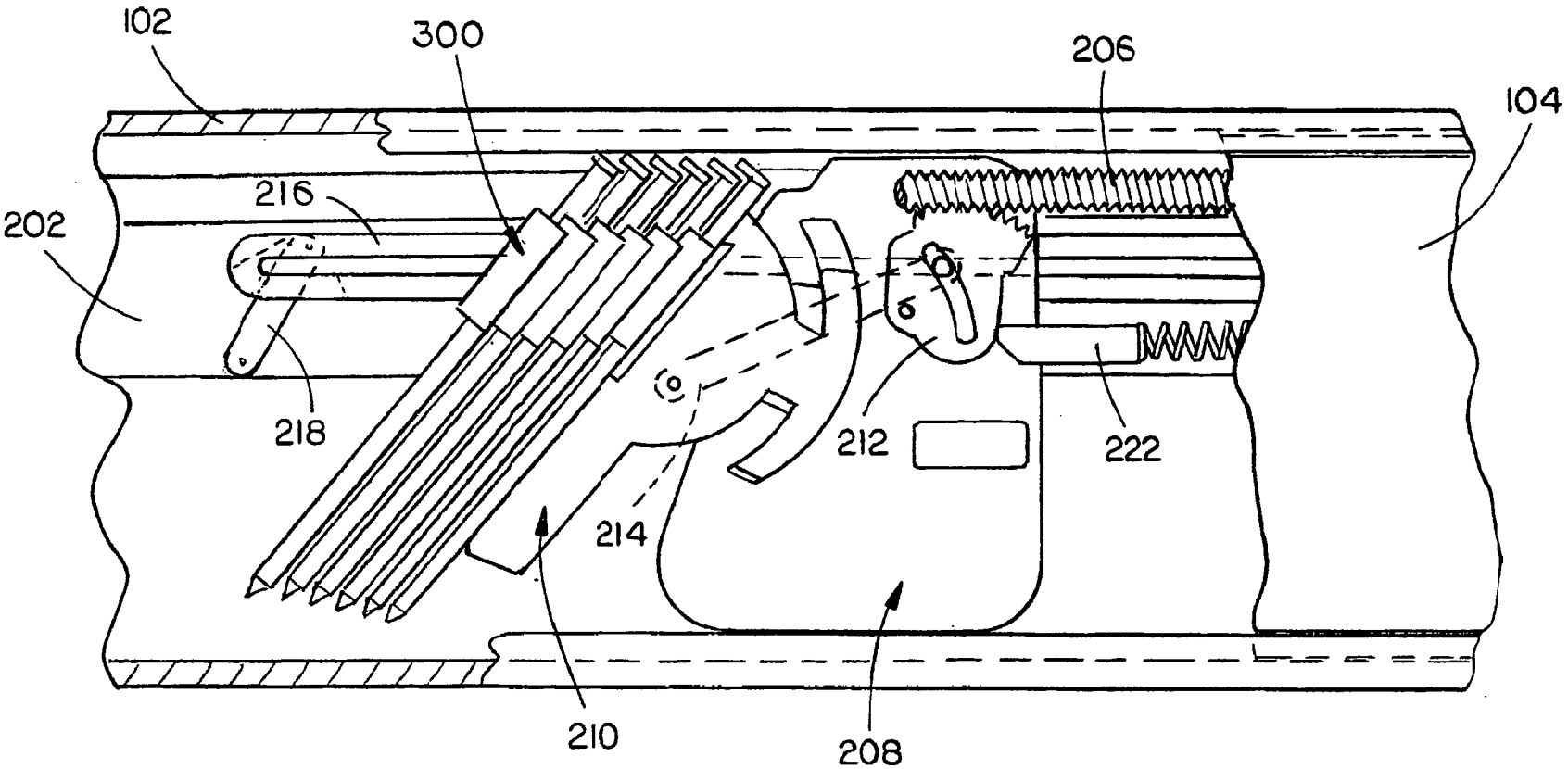
FIG. 4 is a cut-away view of the nail lock out assembly in a position where the clipped-head nail strip is being prevented from advancing.

In FIGS. 3 and 4 the nail lock out assembly is shown engaged with a collated nail strip 300. In these preferred embodiments, the collated nail strip 300 comprises collated clipped-head nails. When the housing 102 of the nail lockout assembly is engaged with a adjustable angle nail gun, as shown in FIG. 3, the housing 102 may have its angle of presentation adjusted relative to the nose casting of the adjustable angle nail gun. Typically, the housing 102 may be positioned at a twenty-one degree angle relative to the nose casting when employing round-head nails and at thirty-six degrees relative to the nose casting when employing clipped-head nails. As the desired position of the housing 102 is approached, a projection on the housing 102 contacts and moves the slotted four bar linkage assembly. The slotted guide member 216 moves up, within the base 202, for the twenty-one degree position and down, within the base, for the thirty-six degree position. The positioning of the slotted guide member 216 causes the linkage bar 214 to slide above or below the pivot axis on the pawl assembly 212, the pivot axis of the pawl assembly 212 being located at its point of engagement with the adapter 208. In the current embodiment of FIG. 3, the housing 102 is engaged with the adjustable angle nail gun at a thirty-six degree angle relative to the adjustable angle nose casting 106. Thus, the pusher 210 is engaging the magazine 300 in the proper alignment which results in the linkage bar 214 sliding below the pivot axis on the pawl assembly 212, thereby rotating the pawl assembly 212 clockwise, into the first position, and preventing the pawl serrated member 227 from engaging with the cover serrated member 206 and allowing the collated nail strip 300 to advance.

When a clipped-head magazine is loaded into the housing 102 which has been set at a twenty one degree angle relative to the adjustable angle nose casting assembly 106 the force applied by the collated nail strip 300 on the pusher 210 causes the linkage bar 214 to slide above the pivot axis of the pawl assembly 212 causing the pawl assembly 212 to rotate counter-clockwise into the second position. It is understood that a misaligned clipped-head nail may push the pawl assembly 212 as opposed to the pulling action supplied by a misaligned round-head nail. The counter-clockwise rotation in the embodiment shown in FIG. 4, causes the pawl serrated member 227 to mesh with the cover serrated member 206, thus locking the adjustable angle magazine 101, preventing the cover 104 from closing and the clipped-head nail strip from advancing down the housing 102 and engaging within the adjustable angle nose casting assembly 106.

To further explain how the current embodiment of the present invention operates, first a collated nail strip 300 is placed in the housing 102. The cover 104 is engaged with the housing 102 and may be slid down towards the collated nail strip 300. When the nails of the collated nail strip 300 engage with the pusher 210, they rotate the pusher 210 to match the nail collation angle. If the collation angle is incorrect for the corresponding housing angle relative to the nose casting, the linkage bar 214 causes pawl assembly 212 to rotate counter-clockwise and mesh the pawl serrated member 227 into the cover serrated member 206 disposed on the cover 204, as shown in FIG. 4. If the collation angle is correct for the angle of the housing 102 relative to the nose casting, linkage bar 214 causes the pawl assembly 212 to rotate clockwise, avoiding engagement of the pawl serrated member 227 with the cover serrated member 206, and thus, the collated nail strip 300 may advance.

The fastening assembly 112 includes a plurality of angular adjustment sites, as exemplified by a first angular adjustment site 120 a second angular adjustment site 122 and a third angular adjustment site 124. The fastening assembly 112 is disposed with a plurality of angle identifiers. The angle identifiers are a series of indicators associated with a printed number (i.e., 30, 29, 28, 27 . . . ) which corresponds to the angle of presentation of the adjustable angle magazine 101 to the adjustable angle nose casting assembly 816. It is contemplated that the angle identifiers may be a label with the numbers printed upon them which may be adhered to the fastening assembly 112. Alternatively, the numbers may be engraved or painted upon the fastening assembly 112.

In the current embodiment, it is understood that the plurality of angular adjustment sites may be engaged by a fastener, such as a bolt, screw, pin, and the like. The fastener may engage through the housing 102 via an adjustment assembly (not shown) comprising a first angular connection site and a second angular connection site. Alternatively, the number of angular connection sites may vary as contemplated by one of ordinary skill. The fastener engages through the first or second angular connection site and connects with one of the plurality of angular adjustment sites.

In an alternative embodiment, the fastening assembly employed by the present invention may be variously configured. For example, the fastening assembly may be implemented using a worm drive assembly. In such a configuration, a threaded shaft may be disposed within the fastening assembly and operationally coupled with a threaded sleeve. The threaded sleeve may be enabled to move up and down the threaded shaft through rotation of a mechanical rotation assembly, which couples with the threaded shaft, by an operator of the adjustable angle nail gun. The threaded sleeve may be coupled with a post which is coupled with the adjustable angle magazine. Thus, as the threaded sleeve moves up and down so does the adjustable angle magazine. Other configurations may include a pneumatic fastening system, hydraulic fastening system, alternative mechanical systems, and the like. For instance, the fastening assembly may utilize the compressed air provided through the compressor connection assembly by redirecting the flow of a portion of the compressed air into a gauge assembly. The gauge assembly may include a readout which provides a visual indication to the operator of the angle of the nail loading assembly relative to the adjustable angle nose casting assembly of the adjustable angle nail gun. Further, the gauge assembly may include an actuator which may allow the operator of the adjustable angle nail gun to alter the flow of the compressed air into the gauge assembly either increasing or decreasing the flow. Alternatively, the gauge assembly may provide a bleed-off valve assembly enabling the operator to regulate the release of the compressed air in the gauge assembly. Either by increasing and decreasing the air flow or bleeding-off the compressed air the operator may change the angle of the adjustable angle magazine relative to the adjustable angle nose casting assembly. The gauge assembly may control the angle of the adjustable angle magazine via a piston assembly engaging with the housing of the adjustable angle magazine. The piston assembly may include a piston engaging a shaft which is coupled with the housing, thus, as the shaft moves so to does the housing of the adjustable angle magazine. It is understood the piston moves the shaft by reacting to changing air pressures within.

In an alternative embodiment, a mechanical fastening system may include a ratchet assembly with a hand brake. The hand brake is engaged by the operator and through pressure applied to the hand brake the ratchet assembly raises or lowers the housing of the adjustable angle magazine. For example, the hand brake may include a spring loaded snap joint which provides incremental adjustments of the angle of the housing relative to the adjustable angle nose casting assembly. The spring loaded snap joint engages a multi-position actuator which engages the ratcheting assembly. The hand brake may be disposed on the handle of the adjustable angle nail gun assembly to provide easy access and control over the adjustable angle nail gun assembly during operation of the hand brake.

In an alternative embodiment the fastening assembly of the adjustable angle nail gun, which enables the angular adjustment of the nail loading assembly relative to the nose casting assembly, may include a linkage assembly that couples with the slotted guide member. Then, as the position of the nail loading assembly is set the linkage assembly may move the slotted guide member up or down depending on the nail types to be employed in the adjustable angle nail gun. The linkage assembly may comprise a guidepost that couples with the slotted guide member and the fastening assembly. When the nail loading assembly is set to a twenty-one degree angle, the guidepost engages the slotted guide member forcing it to move up, or in the alternative when the nail loading assembly is set to a thirty-six degree angle, the guidepost engages the slotted guide member forcing it to move down, similar to the approach described above for the projection in the housing 102.

In an alternative embodiment, the adjustable angle nail gun may be a pneumatic nail gun. Further, the adjustable angle nail gun may be a spring-loaded nail gun assembly. The spring-loaded nail gun assembly utilizing electricity to drive a motor which may engage a spring that drives the driver blade. In another embodiment, the adjustable angle nail gun may be an electromagnetic nail gun assembly utilizing a solenoid to provide the driving force to the driver blade. The solenoid may include an electromagnetic coil with a sliding piston inside it. Other embodiments of the solenoid may include a spring assembly to draw the piston back in. In a still further embodiment, the adjustable angle nail gun may be a combustion nail gun assembly utilizing a piston driven by the firing of gas in a combustion chamber to drive the driver blade. It is contemplated that the adjustable angle nail gun may be configured as a motor driven nail gun. Thus, the adjustable angle nail gun may be configured with electric motors and the like. Further, the motors may include clutch assemblies for providing the needed force to operate the driver blade and drive a nail. The configuration of the motor and clutch assemblies employed may vary as contemplated by one of ordinary skill in the art without departing from the scope and spirit of the present invention.

The adjustable angle magazine 101 provides the operator of the adjustable angle nail gun the ability to use a variety of nail types collated at a variety of angles within the same adjustable angle nail gun. The housing 102 is configured generally to appear as a standard nail gun magazine with the cover 104 slidably coupled with it. The housing 102 may be configured for operation without the cover 104. In alternative embodiments, the housing 102 may be coil-type casing where the connected nails are arranged in a long belt, which winds around a spool. The coil-type casing may be configured in a variety of ways, such as a horizontal coil-type casing or a vertical coil-type casing. The cover 104 may be configured to operate with alternative embodiments, such as the coil-type casing, or may not be included. It is understood that alternative design embodiments of the housing 102 and cover 104 may be employed and do not depart from the scope and spirit of the present invention.

While it is contemplated that the adjustable angle magazine 101 includes a housing 102 coupled with a cover 104 and a loading mechanism such as the nail lock out assembly 200, it is further understood that a universal adapter assembly is coupled with the adjustable angle magazine 101. The universal adapter assembly may include a seating member and a rail member. The rail member may couple with the housing 102 through the use of a fastening device, such as a clip, screw, pin, and the like. The number and location through the rail member and housing 102 where the fasteners are employed may vary as contemplated by one of ordinary skill in the art. In the preferred embodiment, the universal adapter assembly may be coupled with the housing 102 at the end of the housing 102 that engages with a adjustable angle nail gun. A first bolt engaged by a first nut and a second bolt engaged by a second nut may secure the universal adapter assembly to the housing 102. The first bolt may engage through a first fastening point disposed on the universal adapter assembly. A first housing fastening point may align with the first fastening point and allow the first bolt to pass through and be engaged by the first nut. The second bolt may pass through a second fastening point and a second fastening point to engage with the second nut. It is understood that the fastening points located on both the universal adapter assembly and the housing 102 may be located in various positions. Further, the method of fastening the universal adapter assembly to the housing 102 may be varied. For example, the universal adapter assembly may be locked in place through a compression lock assembly with a release button assembly to allow for removal from the housing 102.

Preferably, the universal adapter assembly may comprise a seating member coupled with a rail member. The seating member may be designed for engaging a cradle of the adjustable angle nose casting assembly 106. The seating member may comprise a first arm coupled with a second arm. The seating member may further comprise a notch that is disposed across the first and second arm. A transition plate may be coupled to the second arm of the seating member. The first and second arm may be configured with rounded heads for engagement with the cradle. This rounded head configuration enables rotational movement of the seating member once engaged with the cradle. The notch may be disposed across both the first and second arm and may be engaged by a fastener of a fastening assembly to secure its position. The fastener may be received through a first and second fastener receiver disposed on opposite sides of the cradle and proximal to the position of the seating member when engaged with the cradle. Preferably, the notch may comprise a smooth surface to allow the fastener to slide upon it thereby enabling the rotational movement of the seating member.

The transition plate may provide a connection to the adjustable angle magazine 101. The transition plate may engage with the adjustable angle magazine 101 to securely affix the seating member. The transition plate may couple with the housing 102 through the use of a bolt and a nut. The bolt may engage the transition plate by first engaging a housing fastening point and next a transition plate fastening point. In the present embodiment, the housing fastening point and transition plate fastening point are apertures. The bolt may then engage the nut to fasten the housing 102 to the transition plate. It is also contemplated that a variety of fasteners may be used to couple the transition plate with the housing 102, such as clips, screws, pins, and the like. The rail member may provide further connection to the adjustable angle magazine 101. The rail member may also couple along a side of the adjustable angle magazine 101.

It is also contemplated that a support assembly comprising a first support member disposed on a housing 102 and a second support member disposed on a cover 104 may provide additional support for the adjustable angle magazine 101. The first and second support member may be configured to engage with a first support bar and a second support bar that protrude from an adjustable angle nose casting assembly 106. The engagement of the support bars and members may provide stability to the adjustable angle nail gun 100 during operation. In the preferred embodiment, the first and second support members may comprise a section of the cover and housing, respectively, and include serrated or toothed sections. These serrated or toothed sections of the first and second support member may be designed to engage with complimentary serrated or toothed sections disposed upon the first and second support bar. Additionally, this combination may be designed to be releasably engaged, allowing for the easy adjustment of the angle of the housing 102 relative to the adjustable angle nose casting assembly 106.

In the alternative the first and second support members may be coupled to the first and second support bars and include a mechanism for concomitant adjustment when the adjustment assembly is re-adjusted. For example, a worm drive assembly may be employed that allows for movement to adjust and then locks in place when the desired position has been reached. Alternatively, a compression lock assembly may be employed to accomplish the same re-positioning enabled by the adjustment assembly in combination with the adjustable angle nail gun fastening assembly discussed previously.

It is also contemplated that in other embodiments of the present invention a compression cover may be coupled with the housing 102. The compression cover may engage with the housing 102 through a compression lock system comprising a plurality of compression clips disposed on the cover 104 and through points disposed on the housing 102. Other systems and methods of coupling the cover to the housing may be employed as contemplated by one of ordinary skill in the art.

Further, the adjustable angle magazine of the present invention may be disposed with various other devices and mechanisms. These may include a pick-off pivot assembly, an articulating pusher assembly, a nail checker assembly, a nail lockout assembly, a nail spacing verification assembly, a nail shank pawl assembly, and a pinion nail verification assembly. Additionally, the adjustable angle magazine may be enabled as a top-loading magazine, a side-loading magazine, and the like as may be contemplated by one of ordinary skill in the art.

Figure 5:
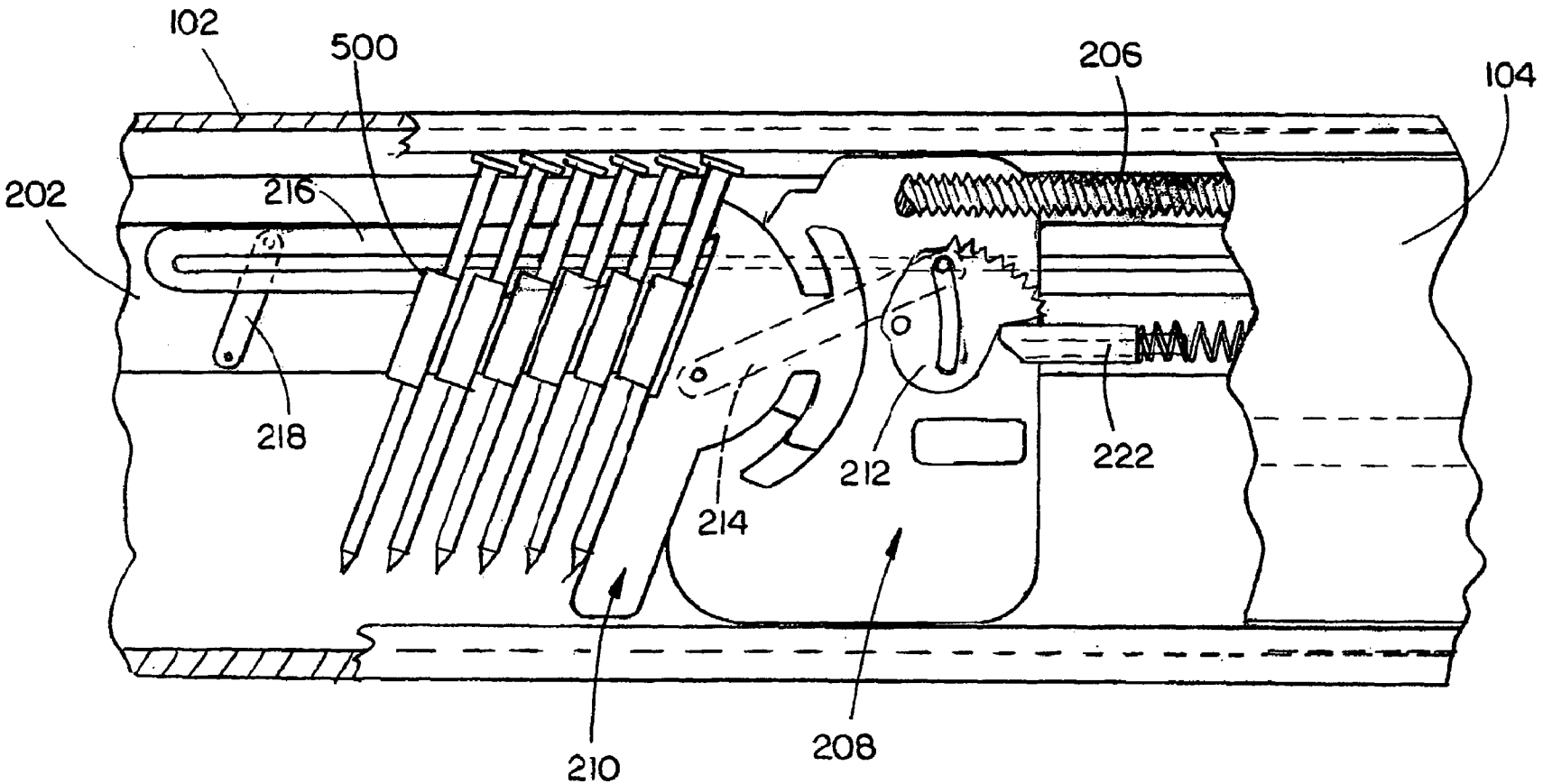
FIG. 5 is a cut-away view of the nail lock out assembly in a position where a round-head nail strip is being allowed to advance.

Referring now to FIG. 5, a collated nail strip 500 is shown disposed within the housing 102 of the adjustable angle magazine 101. The collated nail strip 500 is a collated magazine of round-head nails. In the present embodiment, the adjustable angle magazine is being coupled with the adjustable angle nose casting assembly 106 (not shown) at a twenty-one degree angle. The slotted guide member 216 is in an up position within the base 202 due to the angular setting established for the adjustable angle magazine 101 relative to the adjustable angle nose casting assembly 106, for the use of round-head nails. The pusher 210 rotates within the adapter 208 until it engages against the top edge 205 of the slotted pusher coupling assembly 203. In the present embodiment, the pusher 210 engages against the round-head nail strip 300 and due to the proper alignment of the strip 300 relative to the pusher 210 the linkage bar 214 slides below the pivot axis of the pawl assembly 212. The operational coupling of the linkage bar 214 below the pivot axis of the pawl assembly 212 causes the pawl assembly 212 to rotate clock-wise into the first position. This clock-wise rotation prevents the pawl assembly 212 from meshing the pawl serrated member 227 with the cover serrated member 206, thus the strip 300 is allowed to advance within the housing 102 of the adjustable angle magazine 101.

Figure 6:
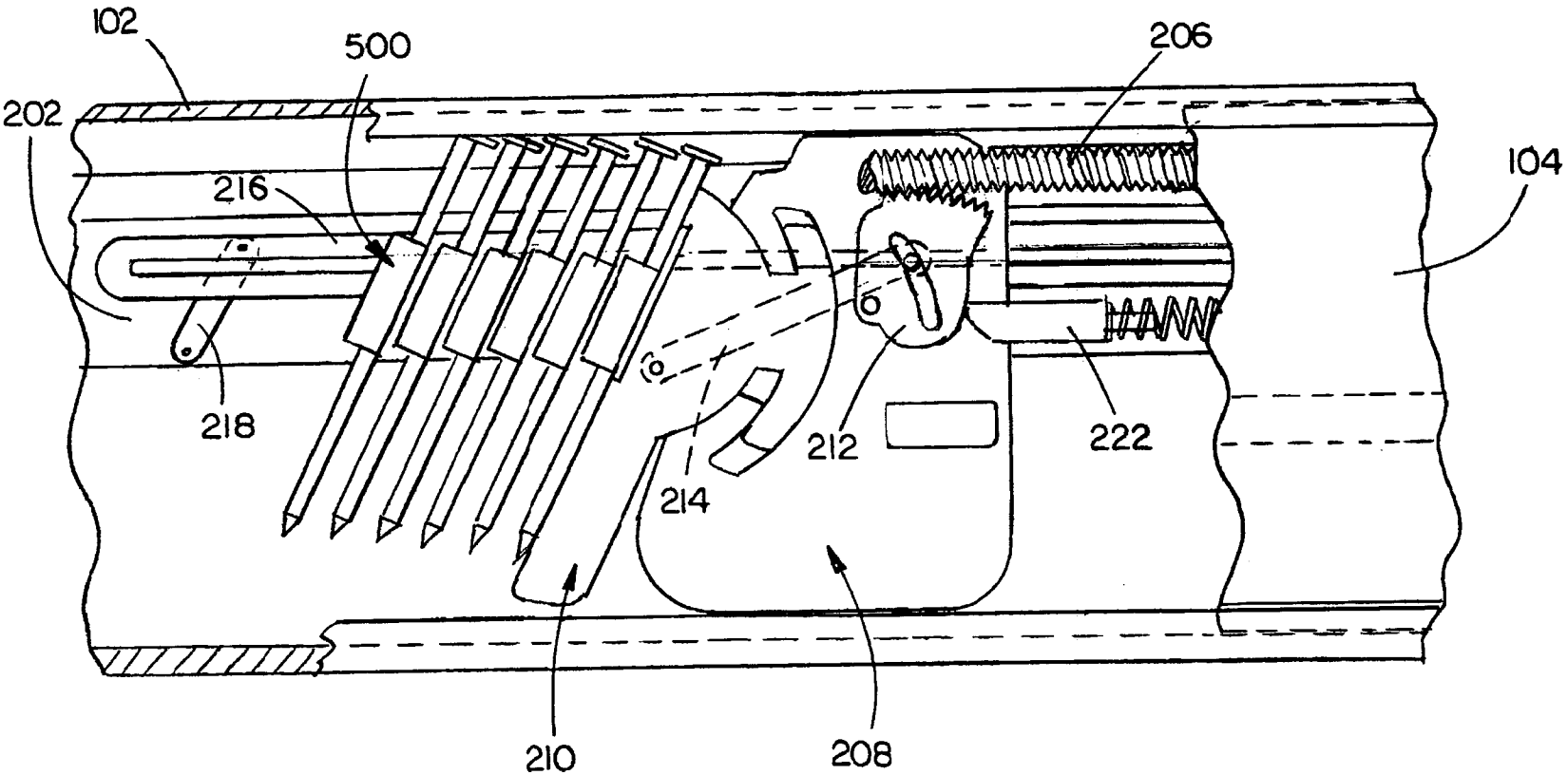
FIG. 6 is a cut-away view of the nail lock out assembly in a position where the round-head nail strip is being prevented from advancing.

FIG. 6 illustrates that when the round-head collated nail strip 500 is loaded into the housing 102 which has been set at a thirty-six degree angle relative to the adjustable angle nose casting assembly 106 the force applied by the collated nail strip 500 on the pusher 210 causes the linkage bar 214 to slide above the pivot axis of the pawl assembly 212 causing the pawl assembly 212 to rotate counter-clockwise into the second position. The counter-clockwise rotation, in the embodiment shown in FIG. 6, causes the pawl assembly 212 to mesh the pawl serrated member 227 with the cover serrated member 206, thus locking the adjustable angle magazine 101, preventing the cover 104 from closing and the strip 500 from advancing down the housing 102 and engaging within the adjustable angle nose casting assembly 106.

Figure 7:
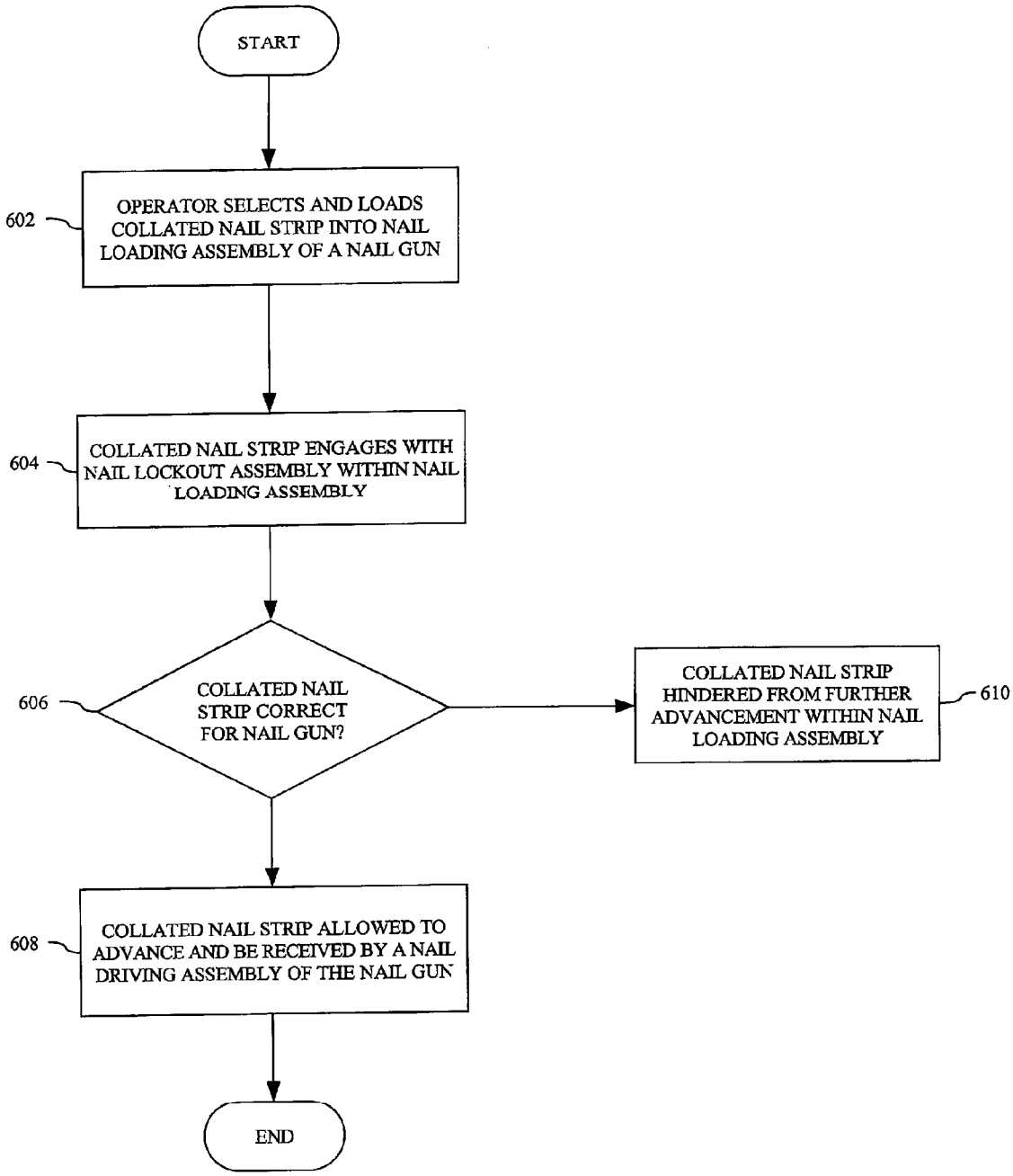
FIG. 7 is a flowchart illustrating a method for using a nail gun by determining whether a collated nail strip is correct for the nail gun.

A method for determining whether a proper collated nail strip is being advanced to a nail driving assembly from a nail loading assembly of a adjustable angle nail gun, is shown in FIG. 7. In a first step 602, the operator of the adjustable angle nail gun initially loads a collated nail strip into the nail loading assembly. It is understood that the collated nail strip may be loaded into a nail loading assembly with various loading configurations, such as rear-loading, top-loading, side-loading, and the like. The nails of the collated nail strip, in step 604, engage with a nail lockout assembly disposed within the nail loading assembly. In step 606 the nail lockout assembly determines if the collated nail strip, which is being advanced through the nail loading assembly to the nail driving assembly for operation upon by the nail driving assembly, is providing the nails in the correct position for the adjustable angle nail gun. If it is determined that the nails being provided are in the correct position for operation upon by the nail driving assembly, then in step 608 the nail lockout assembly allows the collated nail strip to advance. The advancing collated nail strip has the nails received by the nail driving assembly where the nails may be driven. If, however, it is determined that the nails being provided are incorrectly positioned for operation upon by the nail driving assembly, then in step 610 the nail lockout assembly prevents the collated nail strip from advancing by engaging with the nails and locking in position, thereby locking the nail strip in place within the adjustable angle nail gun. When the nail lockout assembly locks in position and prevents further advancement of the collated nail strip, the operator of the adjustable angle nail gun is provided an indication that the collated nail strip the operator selected is incorrect for use with the adjustable angle nail gun.

It is understood that the specific order or hierarchy of steps in the methods disclosed are examples of exemplary approaches. Based upon design preferences, it is understood that the specific order or hierarchy of steps in the method can be rearranged while remaining within the scope and spirit of the present invention. The accompanying method claims present elements of the various steps in a sample order, and are not necessarily meant to be limited to the specific order or hierarchy presented.

It is believed that the present invention and many of its attendant advantages may be understood by the forgoing description. It is also believed that it may be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A nail lockout assembly for use with a nail gun, comprising:

a slotted guide member for engaging a projection disposed in a nail loading assembly of the nail gun and for identifying the angle of coupling of the nail loading assembly to a nail driving assembly of the nail gun;

a linkage bar coupled with the slotted guide member, the linkage bar for translating the movement of the slotted guide member;

a pusher coupled with the linkage bar, the pusher for engaging a nail and translating the alignment of the nail, by rotation of the pusher, to the linkage bar;

a pawl assembly coupled with the linkage bar, the pawl assembly for rotating into a first or a second position based on the position of the linkage bar;

an adapter coupled with the pusher and the pawl assembly, the adapter for enabling the rotational movement of the pusher and the pawl assembly; and a cover serrated member disposed on a cover of the nail loading assembly, the cover serrated member for engaging the pawl assembly in a second position, wherein the pawl assembly engages with the cover serrated member and prevents the cover from closing and the nail from advancing when the nail, based on the angle of coupling of the nail loading assembly to the nail driving assembly, is improperly aligned with the pusher assembly.

2. The nail lockout assembly of claim 1, wherein the nail loading assembly is an adjustable angle magazine.

3. The nail lockout assembly of claim 2, wherein the adjustable angle magazine further comprises a universal adapter assembly.

4. The nail lockout assembly of claim 2, wherein the adjustable angle magazine further comprises a pick-off pivot assembly.

5. The nail lockout assembly of claim 2, wherein the adjustable angle magazine further comprises a nail shank pawl assembly.

6. The nail lockout assembly of claim 1, wherein the adjustable angle magazine is enabled as a top-load or side-load magazine.

7. The nail lockout assembly of claim 1, wherein the nail gun is selected from the group consisting of a spring-loaded nail gun, a pneumatic nail gun, an electromagnetic nail gun, a combustion nail gun, and a motor driven nail gun.

8. The nail lockout assembly of claim 1, wherein the nail gun further comprises a clutch assembly.

* * * * *